US012156600B1

(12) United States Patent
Sung et al.

(10) Patent No.: US 12,156,600 B1
(45) Date of Patent: Dec. 3, 2024

(54) FOLDABLE WIG STAND

(71) Applicant: KISS NAIL PRODUCTS, INC, Port Washington, NY (US)

(72) Inventors: Siyong Sung, Port Washington, NY (US); Taehoon Kim, Port Washington, NY (US)

(73) Assignee: KISS NAIL PRODUCTS, INC., Port Washington, NY (US)

( * ) Notice: Subject to any disclaimer, the term of this patent is extended or adjusted under 35 U.S.C. 154(b) by 0 days.

(21) Appl. No.: 18/386,259

(22) Filed: Nov. 2, 2023

(51) Int. Cl.
*A47F 7/06* (2006.01)
*A45D 44/14* (2006.01)

(52) U.S. Cl.
CPC ..... *A47F 7/065* (2013.01); *A45D 44/14* (2013.01)

(58) Field of Classification Search
CPC ..... A47F 7/065; A45D 44/14
See application file for complete search history.

(56) References Cited

U.S. PATENT DOCUMENTS 5,629,057 A * 5/1997 Wang ..... B44C 5/00 428/11
6,135,617 A * 10/2000 Lai ..... F21V 17/007 362/396
6,386,734 B1 * 5/2002 Huang ..... F21V 17/007 362/249.14
6,579,578 B1 * 6/2003 Lai ..... G09F 13/0413 428/20
D574,292 S * 8/2008 Jost ..... D11/131
D720,651 S * 1/2015 Lambeth ..... D11/164
9,516,941 B1 12/2016 Moulton
10,161,601 B1 * 12/2018 Chen ..... F21S 6/00
10,295,130 B1 * 5/2019 Owens ..... G09F 23/04
10,480,759 B2 * 11/2019 Lu ..... F21L 19/006
10,905,261 B2 2/2021 Simmons

FOREIGN PATENT DOCUMENTS

KR 10-2009-0103017 10/2009
KR 10-2023-0005703 1/2023

* cited by examiner

*Primary Examiner* — Ko H Chan
(74) *Attorney, Agent, or Firm* — PnK IP LLC

(57) ABSTRACT

A foldable wig stand includes: a head part configured to support a wig while being inserted into the inside of the wig; and a leg part supporting the head part and including a first leg frame and a second leg frame. Both side ends of the head part are hinged to both upper sides of the first leg frame and are rotatable in a first direction. The first leg frame and the second leg frame are hinged to each other at upper and lower central intersection portions, and are configured to be rotatable in a second direction different from the first direction.

12 Claims, 10 Drawing Sheets

(a)

(b)

(a)

(b)

(a)

(b)

FOLDABLE WIG STAND

BACKGROUND

Field

Embodiments of the invention relate generally to a wig stand, and more particularly, to a foldable wig stand in which a head part and a leg part are configured to be collapsible coupled.

Discussion of the Background

Wig stands are generally used to store or display wigs. Generally, a wig stand may include a head part inserted into an opening of a wig (an entrance where a user's head is inserted) and a leg part supporting the head part, so that the wig placed on the wig stand can be supported while maintaining its shape.

Conventionally, when not in use, the head and the leg part of the wig stand were separated and stored, and when used, the head and leg part were combined and used. Thus, it caused the inconvenience of having to assemble, disassemble, and reassemble each time the wig stand was used or stored.

The above information disclosed in this Background section is only for understanding of the background of the inventive concepts, and, therefore, it may contain information that does not constitute prior art.

SUMMARY

Foldable wig stands constructed according to the principles and implementations of the invention are capable of easily mounting a wig without separate assemble, disassemble, and reassemble process since a head part and first and second leg frames included in the foldable wig stand are configured to be collapsible coupled.

In addition, foldable wig stands constructed according to the principles and implementations of the invention are capable of stably supporting the wig since when the first and second leg frames are unfolded they are firmly combined to each other.

According to embodiments of the invention, it is easy to store and a space utilization is high during being stored in a package since the foldable wig stand can be unfolded when in use and folded and stored when not in use.

Additional features of the inventive concepts will be set forth in the description which follows, and in part will be apparent from the description, or may be learned by practice of the inventive concepts.

According to one aspect of the invention, a foldable wig stand includes: a head part configured to support a wig while being inserted into the inside of the wig; and a leg part supporting the head part and including a first leg frame and a second leg frame, wherein both side ends of the head part are hinged to both upper sides of the first leg frame and are rotatable in a first direction, and wherein the first leg frame and the second leg frame are hinged to each other at upper and lower central intersection portions, and are configured to be rotatable in a second direction different from the first direction.

The head part may have a circular dome shape in which the upper surface is curved convexly upward and the lower surface is curved concavely upward.

The first leg frame may include hinge shafts protruding in the second direction and formed at upper outer ends of the first leg frame, and the head part may include couplers configured to be rotatably coupled with the hinge shafts and formed on both side ends of the head part.

The head part may further include connecting bridges connecting the couplers and side edges of the head part, the connecting bridge having a downward arch shape protruding from the side edge of the head part.

Each of the first and second leg frames may include a flat upper end portion, a side portion extending from the upper end portion toward downward, and a lower end portion including two feet on both sides with a bottom center curved convexly upward.

A rotation shaft pin protruding from the first leg frame may be configured to be rotatably coupled to a pin hole formed in the second frame.

Recess areas may be formed at the central intersection portions of the first leg frame and the second leg frame, respectively, at least one locking protrusion may be formed on the concave side surface of the rotation shaft pin, and at least one locking groove to support the locking protrusion may be formed on the concave side surface of the pin hole.

Both of the locking protrusion and locking groove may have a substantially triangular cross section.

The head part may further include a fixing rib protruding from a lower inner edge of the head part.

The fixing rib may be formed in the form of an annular rib protruding along the lower inner circumference of the head part.

The fixing rib may include a first portion in which a height increases as the lower end surface moves outward from the center of the head part and a second portion formed at a certain section on the front and rear end sides with a substantially same height.

The first leg frame may include a side protrusion formed along the longitudinal direction on one side in contact with the second leg frame.

The second leg frame may include a side groove corresponding to the side protrusion and formed on one side of the second leg frame.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate illustrative embodiments of the invention, and together with the description serve to explain the inventive concepts.

DETAILED DESCRIPTION

Figure 1:
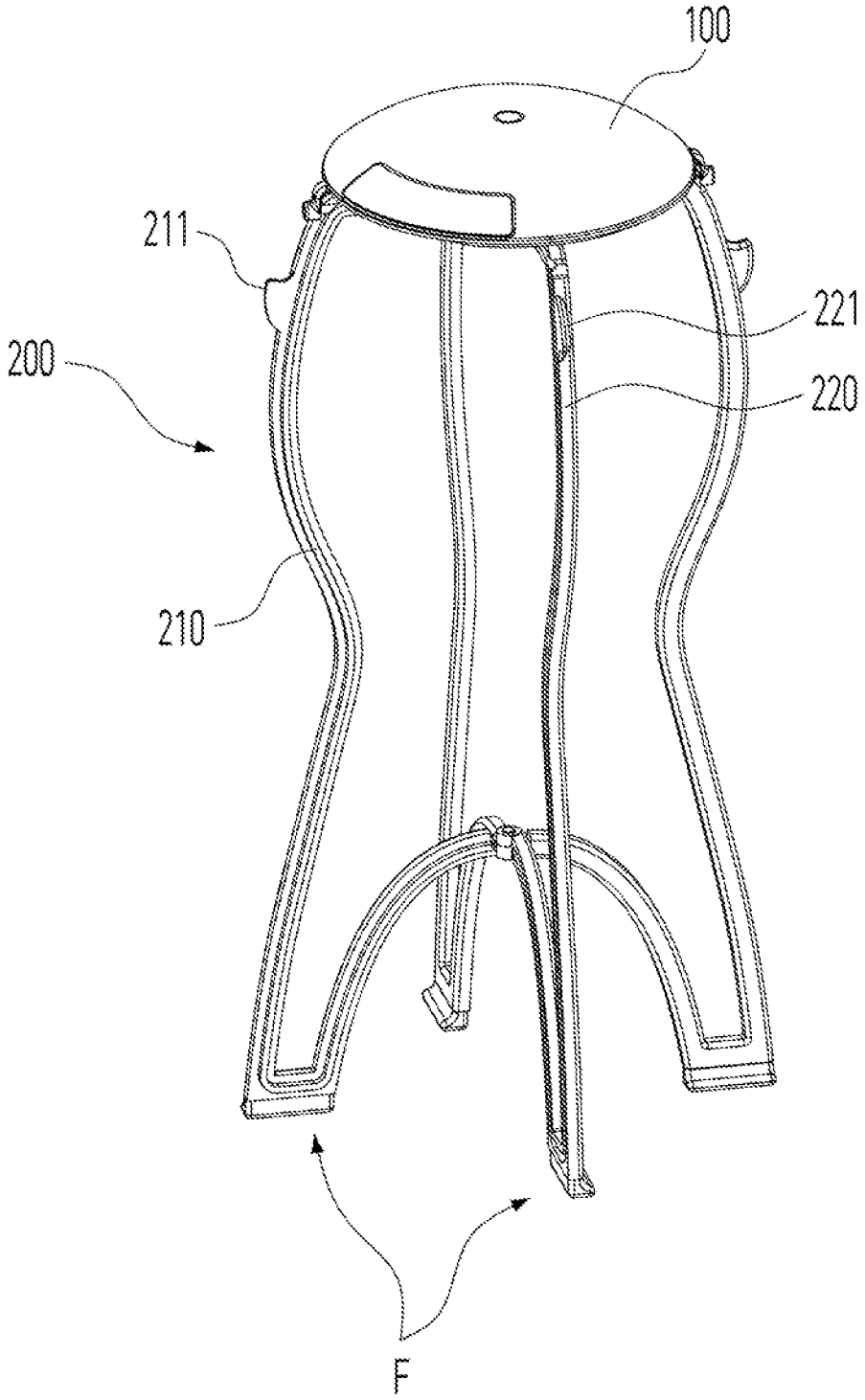
FIG. 1 is a perspective view of an embodiment of a foldable wig stand constructed according to the principles of the invention.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing illustrative features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z—axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Figure 2:
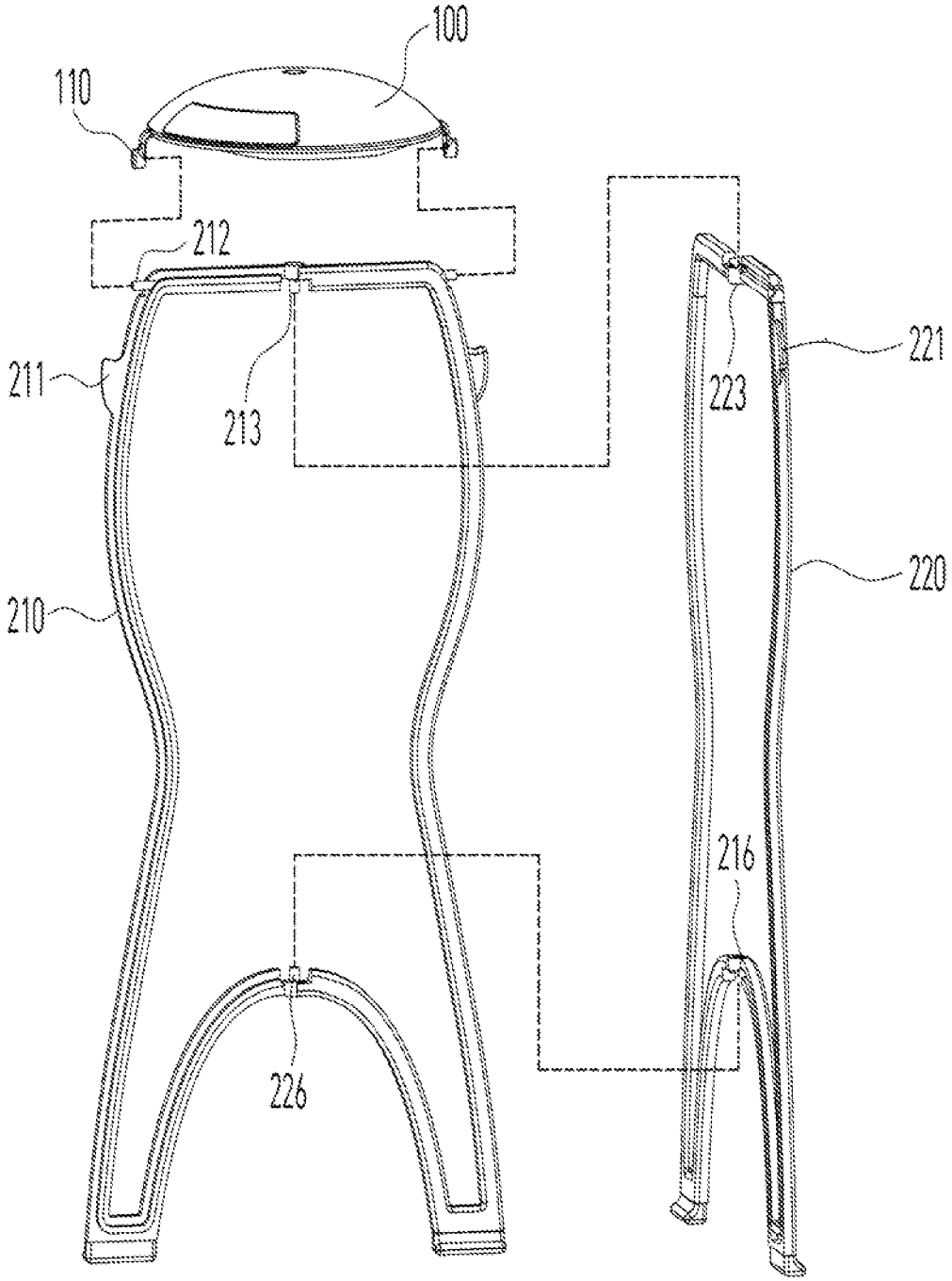
FIG. 2 is an exploded perspective view of the foldable wig stand shown in FIG. 1.

FIG. 1 is a perspective view of an embodiment of a foldable wig stand constructed according to the principles of the invention and FIG. 2 is an exploded perspective view of the foldable wig stand shown in FIG. 1.

As shown in FIGS. 1 and 2, the foldable wig stand according to an embodiment of the invention includes a head part 100 and a leg part 200.

The head part 100 has a shape corresponding to the shape of the upper portion of a human head and is a part that supports the wig while being inserted into the upper inner part of the wig. For example, an upper surface of the head part 100 is generally curved convexly upward and a lower surface of the head part 100 is curved concavely upward to form an overall circular dome shape that is convex upward.

The leg part 200 is configured to support the head part and includes a first leg frame 210 and a second leg frame 220 as shown in FIG. 1.

The head part 100 may be rotatably hinged to a first leg frame 210 of the leg part 200, which will be described later. For this purpose, as shown in FIG. 2, couplers 110 are provided on both left and right sides of the head part 100, respectively. In other words, both side ends of the head part 100 are hinged to both upper sides of the first leg frame 210 and are rotatable in a first direction.

Further, the first leg frame 210 and the second leg frame 220 are also hinged to each other at upper and lower central intersection portions, and are configured to be rotatable in a second direction different from the first direction, which will be described later.

Figure 3:
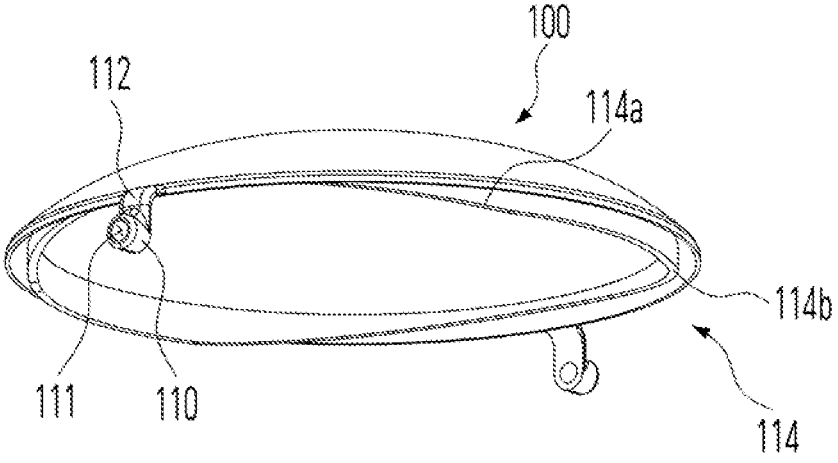
FIG. 3 shows a head part configuration of the foldable wig stand shown in FIG. 1.
Figure 3:
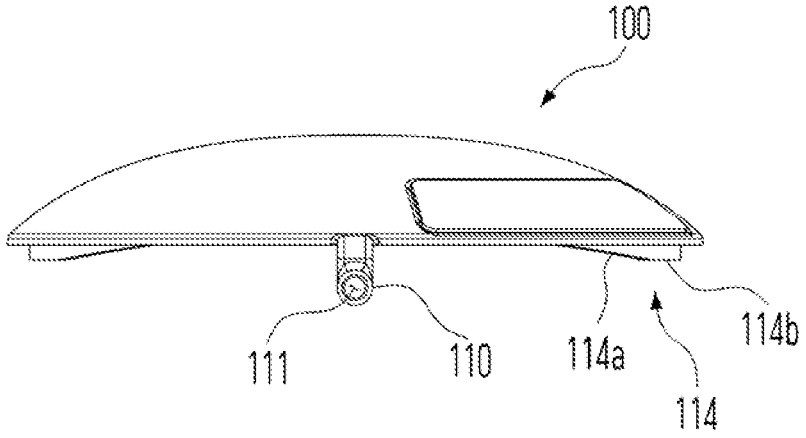

FIG. 3 shows a head part configuration of the foldable wig stand shown in FIG. 1. Specifically, FIG. 3(*a*) is a perspective view of the head part 100 and FIG. 3(*b*) is a side view of the head part 100.

As shown in FIG. 3, couplers 110 are formed in the second direction (e.g., a horizontal direction) on both left and right sides of the head part 100. The coupler 110 includes a hinge shaft groove 111 formed in the center, and the hinge shaft groove 111 may be a hollow cylindrical body that can be formed in the second direction toward the center of the head part 100. Further, the coupler 110 may be spaced a predetermined distance downward from the side edge of the head part 100 to prevent interference with the first leg frame 210, which will be described later, when the head part 100 is rotated. For this purpose, the side edge of the head part 100 and the inner end of the coupler 110 are connected to each other by a connecting bridge 112.

The connecting bridge 112 may have a downward arch shape that protrudes and extends from the side edge of the head part 100, as shown in FIGS. 1 to 3. For example, the head part 100, the coupler 110, and the connecting bridge 112 may be individual parts separately and may be coupled to each other. However, embodiments are not limited thereof, so they may be formed as one body through a same injection molding process.

The coupler 110 of the head part 100 may be coupled to a hinge shaft 212 provided on the outside of the first leg frame 210, which will be described later in detail.

Meanwhile, as shown in FIGS. 3(*a*) and 3(*b*), fixing rib 114 may be protruding from the front and rear edges of the lower inner side of the head part 100.

The fixing rib 114 is provided to fix the head part 100 in a horizontal state after the head part 100 is rotated in the first direction. Thus, when the wig stand is unfolded, the head part 100 can be maintained in a horizontal state without moving while contacting the upper end of a second leg frame 220 of the leg part 200. For example, the fixing rib 114 may be disposed on the lower inner side of the head part 100 at a predetermined distance from the edge to the inside and protrudes downward, so that when the wig stand is unfolded, an upper end of the second leg frame 220 contacts the lower end surface of the fixing rib 114. Accordingly, the head part 100 can be fixed and supported in a horizontally unfolded state.

More specifically, as shown in FIGS. 3(*a*) and 3(*b*), the fixing rib 114 may be in the form of an annular rib protruding along the lower inner circumference of the head part 100. Further, the fixing rib 114 may have a first portion 114*a* which is an inclined portion 114*a* in which a height (i.e., a vertical length) increases as the lower end surface moves outward from the center of the head part 100 and a second portion which is a horizontal portion 114*b* formed at a certain section on the front and rear end sides with a substantially same height.

Accordingly, when the second leg frame 220 is unfolded in a folded state of the wig stand, the upper end of the second leg frame 220 moves while contacting the first portion 114*a* (i.e., the inclined portion) of the fixing rib 114, as such the head part 100 is rotated accordingly and arranged horizontally. Also, the head part 100 may be fixedly supported in a horizontal state while the upper end of the second leg frame 220 abuts the second portion 114*b* (i.e., the horizontal portion) of the fixing rib 114.

The head part 100 may be supported from the lower side by the leg part 200. The leg part 200 supports the head part 100 at a certain distance from the ground or the bottom surface of a table. As shown in FIGS. 1 and 2, the leg part 200 may include a leg frame 210 and a second leg frame 220 which are crosses and hinged each other.

Each of the first and second leg frames 210 and 220 may include a flat upper end portion, a side portion extending from the upper end portion toward downward, and a lower end portion including two feet on both sides with a bottom center curved convexly upward.

That is, the first leg frame 210 has a flat upper end portion, a side portion extending vertically for a predetermined length downward, and a lower end portion including two feet (F) supported on both sides on the ground. For example, the first leg frame 210 may have a lower center curved convexly upward and may be divided into two branches, and may be a single closed curved frame composed entirely of wires with a generally rectangular cross-section. The side portion of the first leg frame 210 may extend vertically in a straight line, or may have a curved shape corresponding to the outline connecting the human head, face and neck, as shown in FIG. 1. Further, the hinge shaft 212 is formed to protrude in the second direction (e.g., the horizontal direction) on the outside of the upper end of the first leg frame 210, and the hinge shaft 212 may be rotatably coupled to the coupler 110 formed on the outside of the head part 100.

The second leg frame 220 may have the same overall shape as the first leg frame 210 and may be hinged to the first leg frame 210 by crossing each other. Unlike the first leg frame 210, the second leg frame is not directly coupled to the head part 100. Thus, when the second leg frame 220 is folded as it is rotated relative to the first leg frame 210, the second leg frame 220 overlaps the first leg frame 210, and when the second leg frame 220 is unfolded as it is rotated relative to the first leg frame 210, the second leg frame 220 intersects the first leg frame 210 at a substantially right angle to support the head part 100.

As mentioned above, the first leg frame 210 and the second leg frame 220 are hinged and rotatable with each other. For example, as shown in FIGS. 1 and 2, flat parts at the upper portion of the first leg frame 210 and the second leg frame 220 are overlapping while the central intersection parts are hinge coupled (hinged), and curved parts at the lower portion of the first leg frame 210 and the second leg frame 220 are also overlapping while the central intersection parts are hinged.

Figure 4:
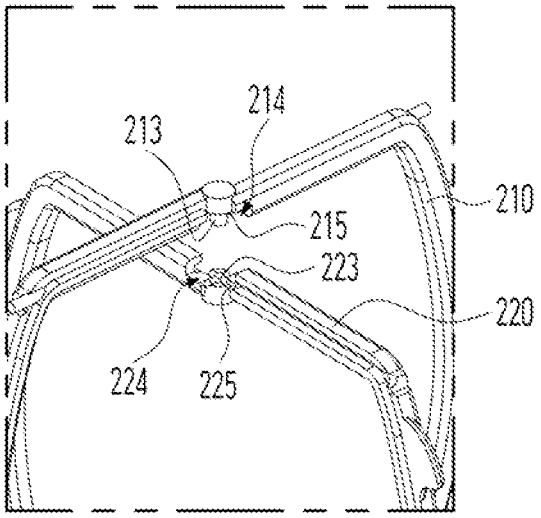
FIG. 4 shows a hinge coupling structure of first and second leg frames of the foldable wig stand shown in FIG. 1.
Figure 4:
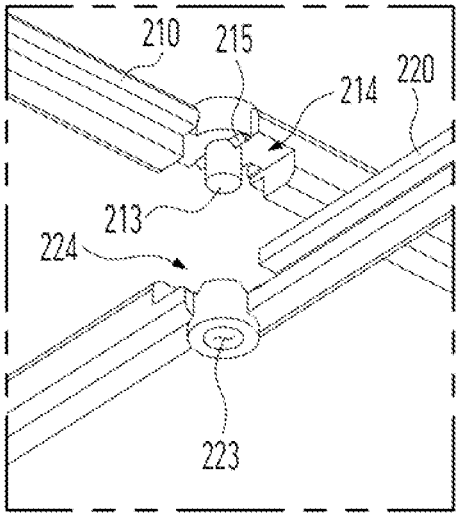

FIG. 4 shows a hinge coupling structure of first and second leg frames of the foldable wig stand shown in FIG. 1.

Specifically, FIG. 4(*a*) is an exploded upper perspective view showing a hinge coupling structure of first and second leg frames and FIG. 4(*b*) is an exploded bottom perspective view showing a hinge coupling structure of first and second leg frames.

As shown in FIGS. 4(*a*) and 4(*b*), a first recess area 214 and a second recess area 224 are formed at a center intersection of the flat upper end portions of the first leg frame 210 and the second leg frame 220, respectively. Specifically, the first recess area 214 is formed in the upper flat portion of the first leg frame 210 downward, and a second recess area 214 is formed in the upper flat portion of the second leg frame 220 upward.

In addition, a first rotation shaft pin 213 is formed to protrude downward at the center of the first recess area 214, and a first pin hole 223 through which the first rotation shaft pin 213 is rotatably coupled is formed in the center of the second recess area 224.

In order to prevent excessive rotation and movement of the second leg frame 220 and to fix the angle when the second leg frame 220 is unfolded, at least one locking protrusion may be formed on the concave side surface of the rotation shaft pin 213, and at least one locking groove to support the locking protrusion may be formed on the concave side surface of the pin hole 223. For example, a first locking protrusion 215 may be formed on the outside of the first rotation shaft pin 213 of the first leg frame 210, and a first locking groove 225 may be formed on the outside of the first pin hole 223 of the second leg frame 220.

More specifically, as shown in FIG. 4(*b*), the first locking protrusion 215 having a generally triangular cross section is formed on the surface of the first recess area 214 on both left and right sides of the first rotation shaft pin 213. The direction of the first locking protrusion 215 may be arranged in a direction perpendicular to the longitudinal direction of the upper flat portion of the first leg frame 210.

Meanwhile, as shown in FIG. 4(*a*), the first locking groove 225 having a generally triangular cross section is formed on the surface of the second recess area 224 outside the first pin hole 223.

For example, the first locking grooves 225 may be arranged in the longitudinal direction of the upper flat part of the second leg frame 220 and in a direction perpendicular thereto. Thus, four first locking grooves 225 may be formed.

According to the embodiment, in a folded or unfolded state according to the second leg frame is rotated, the first locking protrusion 215 is fixed to the first locking groove 225, as such it prevents excessive rotation or movement of the second leg frame 220. Thus the wig stand can be firmly fixed in the unfolded state when in use.

Figure 5:
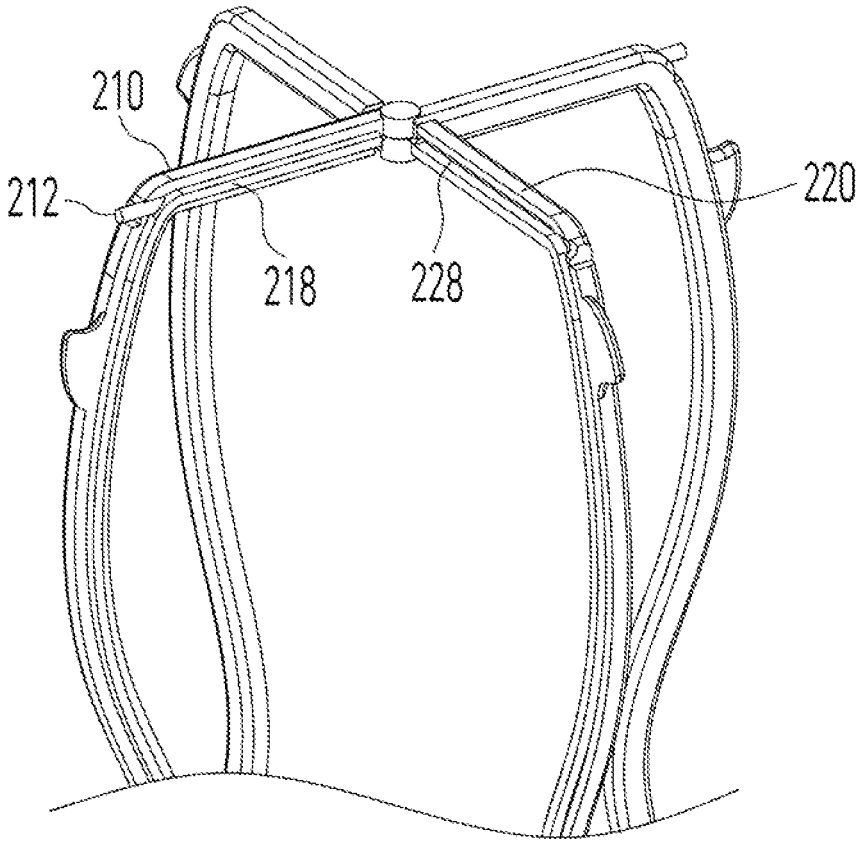
FIG. 5 is an upper perspective view showing a coupling structure of first and second leg frames of the foldable wig stand shown in FIG. 1.
Figure 6:
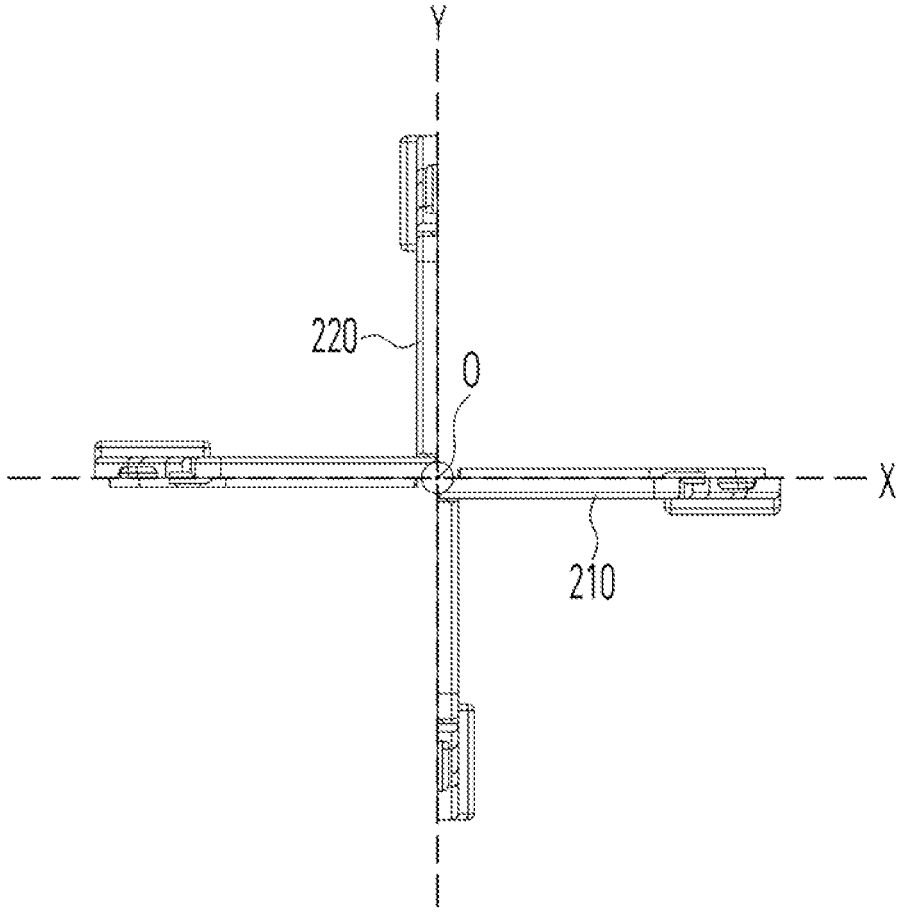
FIG. 6 shows the coupling structure of first and second leg frames of the foldable wig stand shown in FIG. 1 in a plan view.
Figure 6:
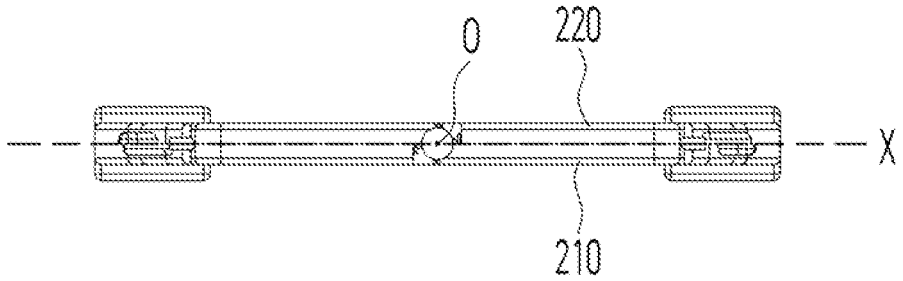

FIG. 5 is an upper perspective view showing a coupling structure of first and second leg frames of the foldable wig stand shown in FIG. 1 and FIG. 6 shows the coupling structure of first and second leg frames of the foldable wig stand shown in FIG. 1 in a plan view.

That is, FIGS. 5 and 6 show a perspective view and a plan view of the first leg frame 210 and the second leg frame 220 in a combined state, respectively.

When the first leg frame 210 and the second leg frame 220 are folded as described above, they overlap each other. At this time, in order to ensure that the overlapped first leg frame 210 and the second leg frame 220 are fixedly coupled to each other without gap or movement, as shown in FIG. 5, the first leg frame 210 includes a side protrusion 218 formed along the longitudinal direction on one side in contact with the second leg frame 220, and the second leg frame 220 includes a side groove 228 corresponding to the side protrusion 218 and formed on one side of the second leg frame 220.

Meanwhile, as shown in FIG. 6(*a*), the first leg frame 210 and the second leg frame 220 are configured to be deflected in opposite directions from each other from an imaginary straight line (X, Y) that passes through the center of the intersection (O) on both left and right sides, respectively. Therefore, when the wig stand is folded as shown in FIG. 6(*b*), the contact boundary surface of the first leg frame 210 and the second leg frame 220 overlapped with each other may coincide with the imaginary straight line (X) passing through the center of the intersection (O). Accordingly, the first leg frame 210 and the second leg frame 220 can be coupled without a gap.

The lower coupling structure of the first leg frame 210 and the second leg frame 220 is substantially the same as the upper coupling structure of the first leg frame 210 and the second leg frame 220 as illustrated above, so detailed description is omitted for convenience of explanation.

When the wig stand is folded, in order for the user to easily grasp the first leg frame 210 and the second leg frame 220, a first knob 211 and a second knob 221 may be formed to protrude on each sides of the first and second leg frames 210 and 220, respectively. For example, the first knob 211 and the second knob 221 may be arranged to be alternately rather than overlapping with each other.

Figure 7:
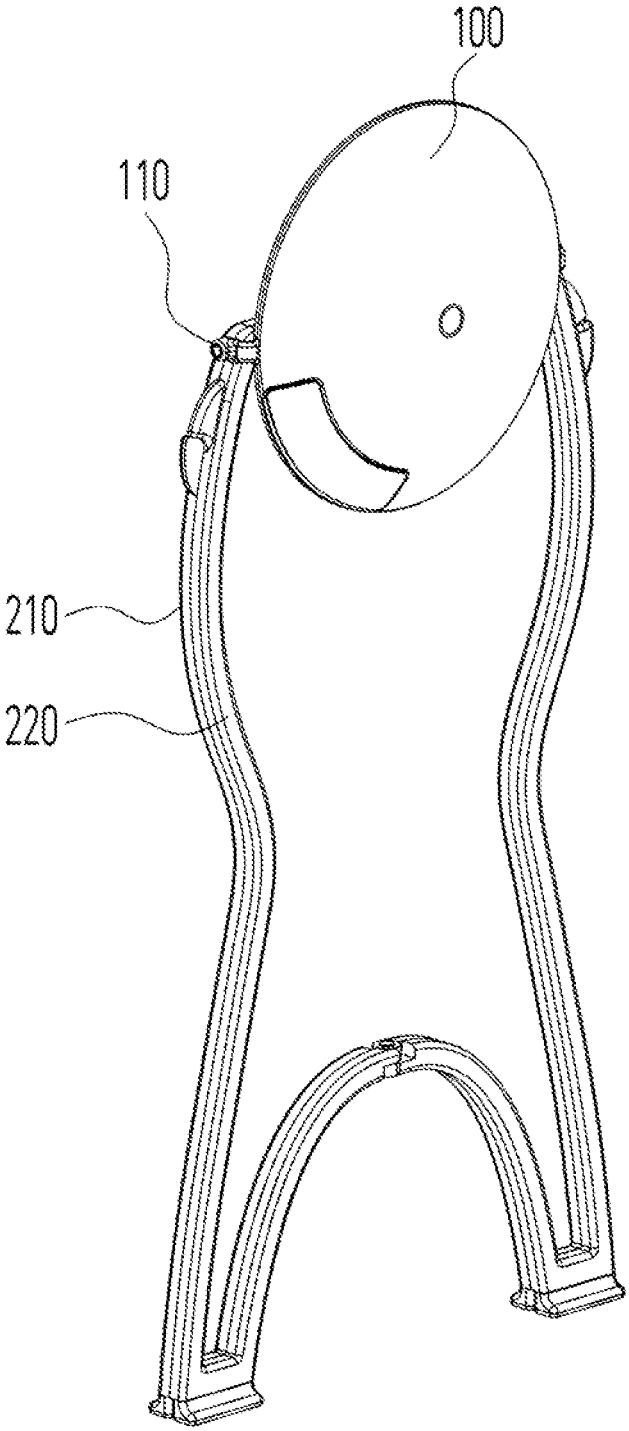
FIG. 7 is a perspective view of the foldable wig stand shown in FIG. 1 in a folded state.
Figure 8:
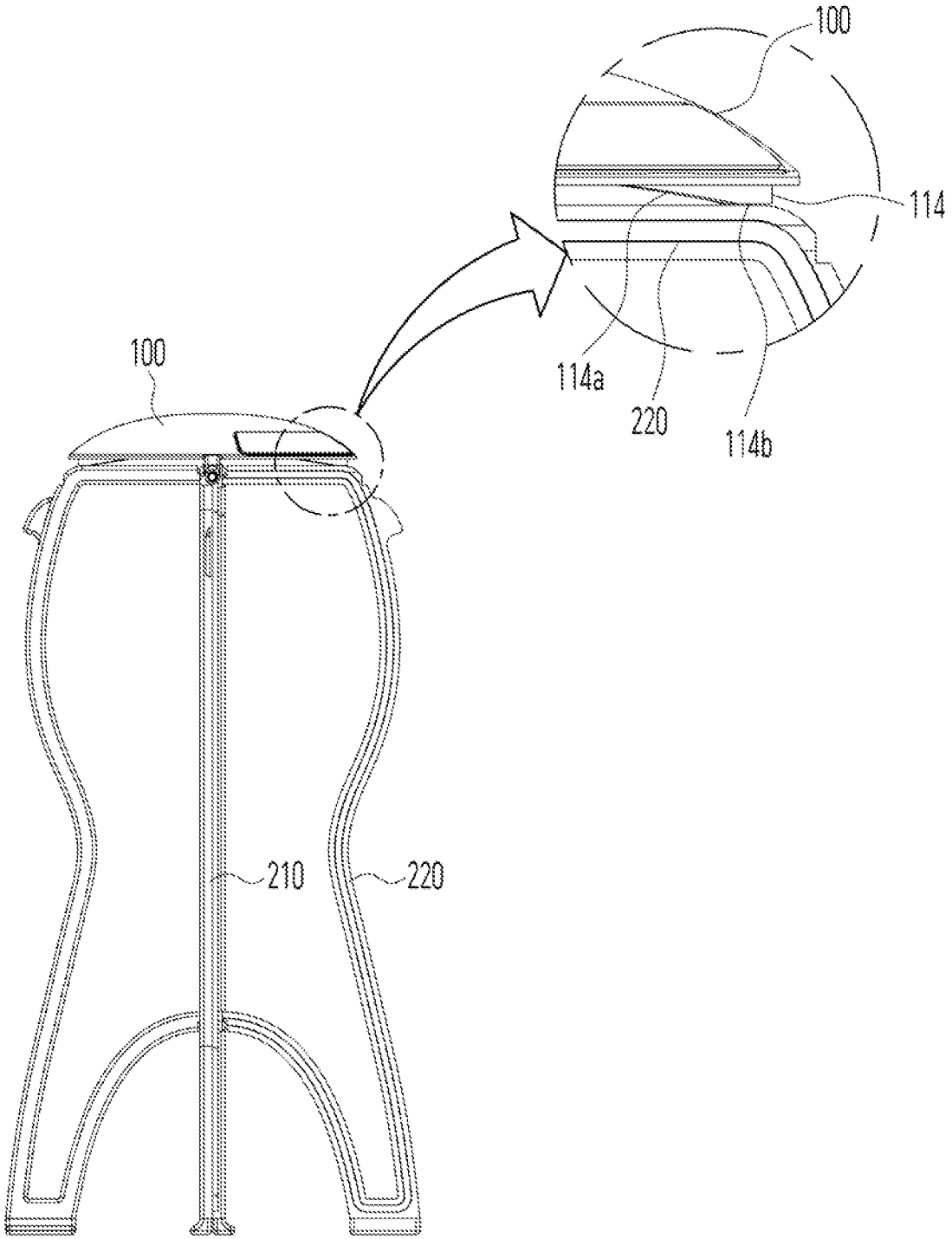
FIG. 8 is a side view of the foldable wig stand shown in FIG. 1 in an unfolded state.

FIG. 7 is a perspective view of the foldable wig stand shown in FIG. 1 in a folded state and FIG. 8 is a side view of the foldable wig stand shown in FIG. 1 in an unfolded state.

When the wig stand is not in use, the wig stand can be stored in a folded state as shown in FIG. 7. In this case, the second leg frame 220 is folded to overlap the first leg frame 210. Also, the head part 100 is rotated around the hinge shaft 212 on the outside of the first leg frame 210, as such the head part 100 is arranged parallel to the first and second leg frames 210, 220 as shown in FIG. 7. Accordingly, the first leg frame 210, the second leg frame 220, and the head part 100 are arranged side by side in the same direction, thereby reducing the volume and increasing space utilization.

On the other hand, in case of using a wig stand, when the second leg frame 220 is moved from the first leg frame 210 and rotated to the other side in the second direction, the first and second leg frames 210, 220 may be spread out (or unfolded) to intersect with each other as shown in FIG. 8.

In addition, when the second leg frame 220 is unfolded, the upper flat portion of the second leg frame 220 moves while contacting the first portion 114*a* (e.g., the inclined portion) of the fixing rib 114, as such the folded head part 100 is rotated upward to be vertical with the previous location of the head part 100 shown in FIG. 7.

Specifically, as shown in the circle of FIG. 8, the upper side end of the second leg frame 220 abuts the second portion 114*b* (e.g., the horizontal portion) of the fixing rib 114, thereby the head part 100 may be supported with maintaining in a horizontal state. Accordingly, in this unfolded state, a wig can be placed on the head part 100 and supported by the foldable wig stand.

Figure 9:
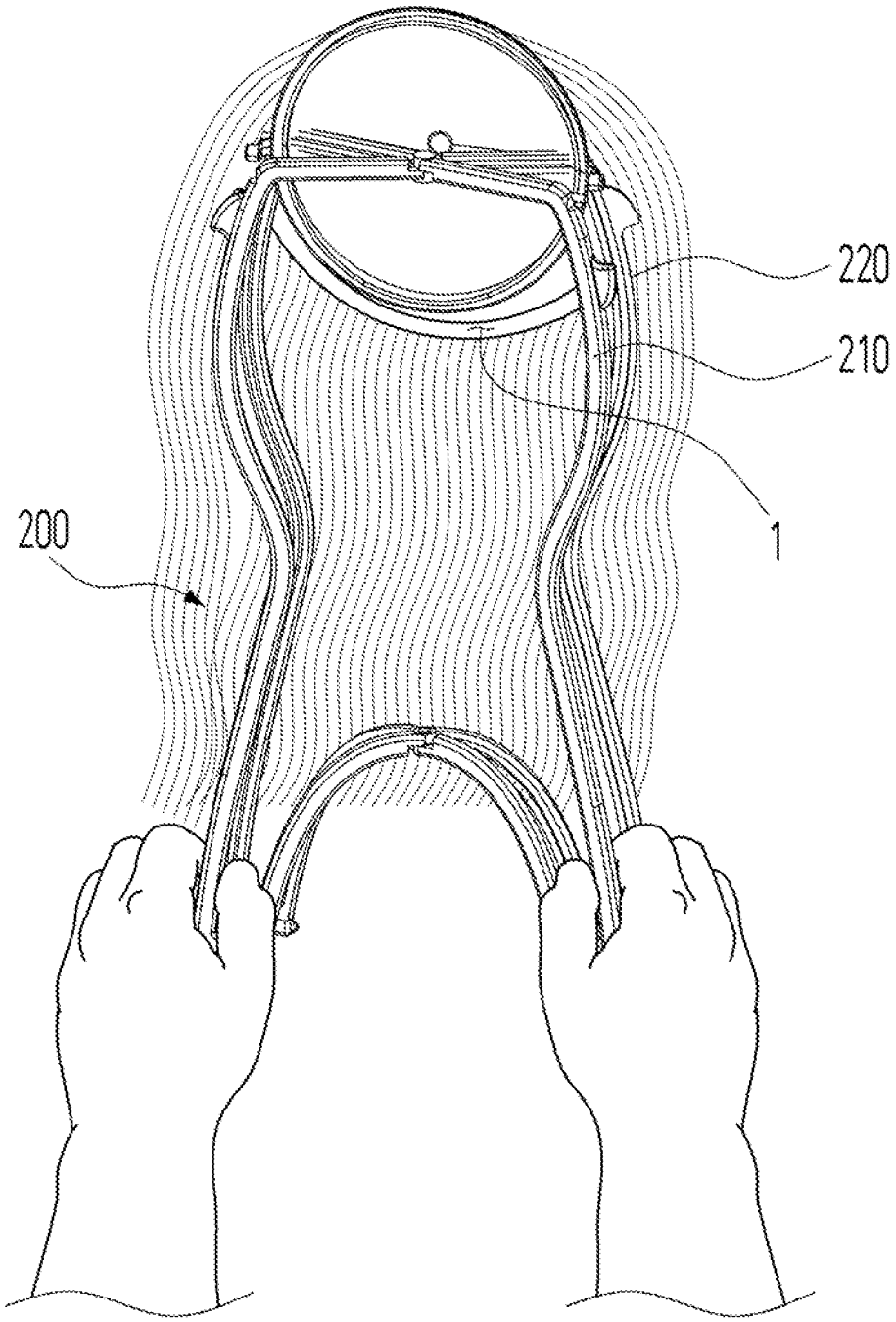
FIG. 9 shows an example of a use of the foldable wig stand shown in FIG. 1.
Figure 10:
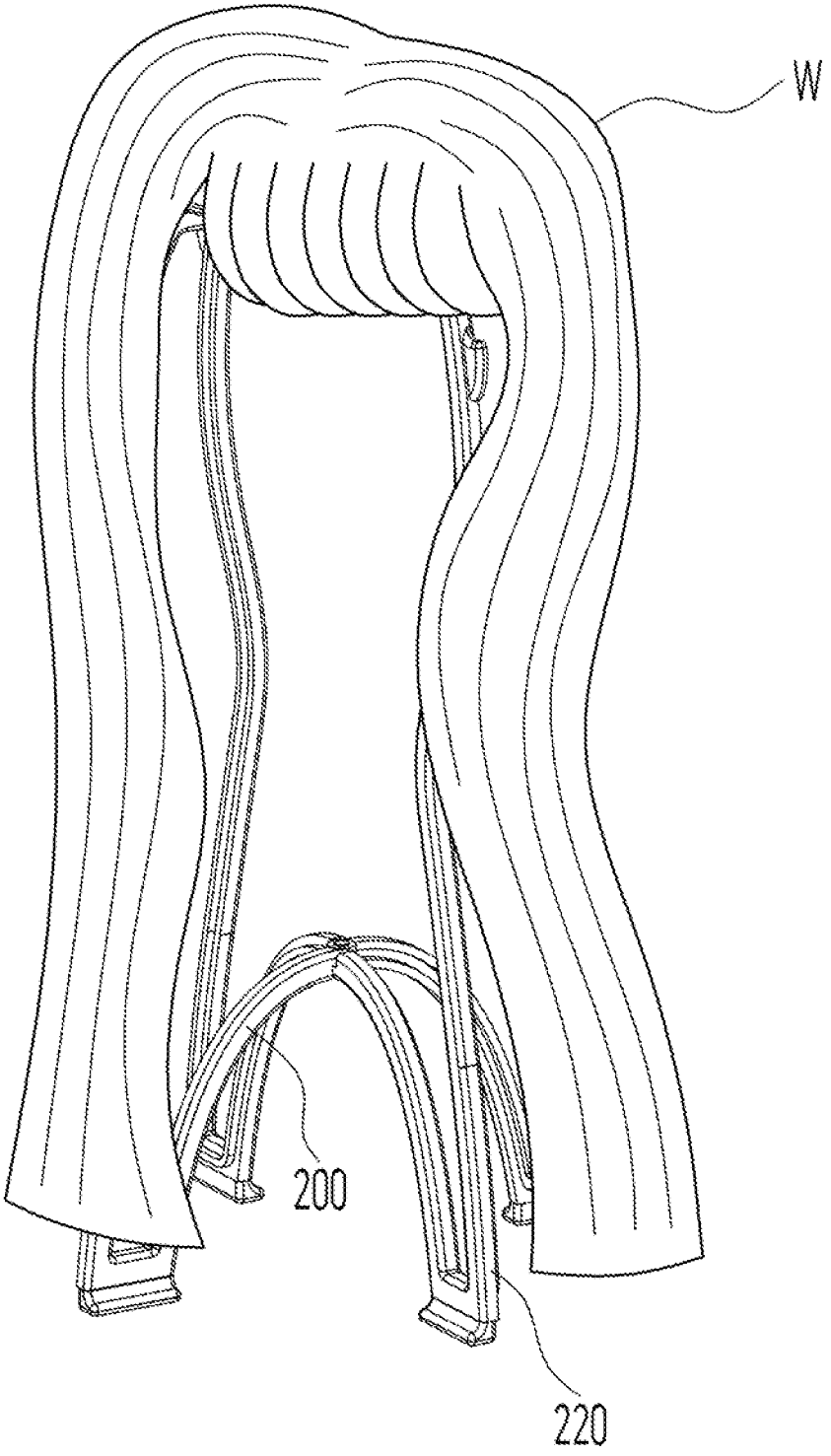
FIG. 10 shows a state in which a wig is mounted on the foldable wig stand shown in FIG. 1.

FIG. 9 shows an example of a use of the foldable wig stand shown in FIG. 1 and FIG. 10 shows a state in which a wig is mounted on the foldable wig stand shown in FIG. 1.

The foldable wig stand according to an embodiment of the invention may support the wig W in a pre-unfolded state as shown in FIG. 8. However, the wig W also can be combined with the foldable wig stand in a folded state as shown in FIG. 7 first, and then second leg frame 220 and the head part 100 can be unfolded to support the wig W.

The process of supporting the wig by the foldable wig stand in a folded state is explained in briefly as follows.

First, as shown in FIG. 9, while the opening (1, the entrance through which the human head enters) of the wig W is spread out on the floor facing upward and the wig stand is folded, the user grasps the first leg frame 210 and the second leg frame 220.

Next, the head part 100 of the wig stand is inserted into the opening 1 of the wig W so that one edge of the head part 100 hangs over the edge of the opening 1.

In this state, when the second leg frame 220 is rotated and unfolded, the head part 100 is also rotated and also the first leg frame 210 and the second leg frame 220 are placed and erected. Thus, the head part 100 may be fixed in a horizontal state by being supported with the first and second leg frames 210 and 220.

In this manner, the foldable wig stand according to an embodiment of the invention can be conveniently stored and used without separate disassembly or reassembly.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A foldable wig stand comprising:

a head part configured to support a wig while being inserted into the inside of the wig and having first and second side ends; and a leg part supporting the head part and including a first leg frame having first and second upper sides and a second leg frame, wherein the first and second side ends of the head part are hinged to the first and second upper sides of the first leg frame, respectively, and are rotatable in a first direction, and wherein the first leg frame and the second leg frame are hinged to each other at a first intersection portion located at an upper central area and a second intersection portion located at a lower central area, and are configured to be rotatable in a second direction different from the first direction, and wherein the head part has a circular dome shape in which an upper surface thereof is curved convexly upward, and a lower surface thereof is curved concavely upward.

2. The foldable wig stand according to claim 1, wherein:

the first leg frame includes hinge shafts protruding in the second direction and formed at upper outer ends of the first leg frame, and the head part includes couplers configured to be rotatably coupled with the hinge shafts and formed on both side ends of the head part.

3. The foldable wig stand according to claim 2, wherein the head part further includes connecting bridges connecting the couplers and side edges of the head part, the connecting bridge having a downward arch shape protruding from the side edge of the head part.

4. The foldable wig stand according to claim 1, wherein each of the first and second leg frames includes a flat upper end portion, a lower end portion having two feet, and a side portion extending from the flat upper end portion to the lower end portion.

5. The foldable wig stand according to claim 4, wherein a rotation shaft pin protruding from the first leg frame is configured to be rotatably coupled to a pin hole formed in the second frame.

6. The foldable wig stand according to claim 5, wherein:

recess areas are formed at the central intersection portions of the first leg frame and the second leg frame, respectively, at least one locking protrusion is formed on the concave side surface of the rotation shaft pin, and at least one locking groove to support the locking protrusion is formed on the concave side surface of the pin hole.

7. The foldable wig stand according to claim 6, wherein both of the locking protrusion and locking groove have a substantially triangular cross section.

8. The foldable wig stand according to claim 1, wherein the head part further includes a fixing rib protruding from a lower inner edge of the head part.

9. The foldable wig stand according to claim 8, wherein the fixing rib is formed in the form of an annular rib protruding along the lower inner circumference of the head part.

10. The foldable wig stand according to claim 9, wherein the fixing rib includes a first portion in which a height increases as the lower end surface moves outward from the center of the head part and a second portion formed at a certain section on the front and rear end sides with a substantially same height.

11. The foldable wig stand according to claim 1, wherein the first leg frame includes a side protrusion formed along the longitudinal direction on one side in contact with the second leg frame.

12. The foldable wig stand according to claim 11, wherein the second leg frame includes a side groove corresponding to the side protrusion and formed on one side of the second leg frame.

* * * * *